United States Patent [19]

Nelson

[11] 4,060,447

[45] Nov. 29, 1977

[54] PROCESS FOR ETCHING OF METAL

[75] Inventor: Warren A. Nelson, Hohokus, N.J.

[73] Assignee: Philip A. Hunt Chemical Corporation, Palisades Park, N.J.

[21] Appl. No.: 671,310

[22] Filed: Mar. 29, 1976

[51] Int. Cl.[2] ..... C23F 1/00

[52] U.S. Cl. ..... 156/642; 134/109; 156/345; 156/666

[58] Field of Search ..... 156/19, 345, 642, 666, 156/901; 134/2, 3, 10, 28, 29, 41, 109; 75/101 BE, 103; 210/32, 38

[56] References Cited

U.S. PATENT DOCUMENTS

| | | | |
|---|---|---|---|
| 3,310,435 | 3/1967 | Robinson, Jr. et al. | 134/10 X |
| 3,532,568 | 10/1970 | Kovell et al. | 156/19 X |
| 3,705,061 | 12/1972 | King | 156/19 |
| 3,905,827 | 9/1975 | Goffredo et al. | 156/19 X |

*Primary Examiner*—William A. Powell

*Assistant Examiner*—Thomas Bokan

*Attorney, Agent, or Firm*—Kirschstein, Kirschstein, Ottinger & Frank

[57] ABSTRACT

An improvement in an etching process in which the etched product, the surface of which is covered with a film of aqueous etching liquid containing ions of the material etched, is rinsed with an aqueous liquid and the resulting liquid, now containing said ions in dilute concentration, is passed through an ion exchanger to selectively remove the ions from the rinse liquid which thereupon can be reused or discharged, without ecological damage, from the ion exchanger. The ion exchanger when laden with such ions is regenerated by passage therethrough of at least a portion of an etcher make-up aqueous replenishing solution which contains a zero or low concentration of said ions. The resulting replenishing solution portion, now containing a small concentration of these ions, is passed to the etcher, e.g., to the etcher sump.

14 Claims, 2 Drawing Figures

PROCESS FOR ETCHING OF METAL

BACKGROUND OF THE INVENTION

1. Field of the Invention

The invention relates to chemical etching of material, often from a substrate, as practiced in varied fields including the manufacture of printed circuits and the like.

2. Description of the Prior Art

There has been increasing concern in the etching industry about the level of etched material in the rinse water of an etching machine, and the resultant pollution of bodies of water. When ion exchange is used to remove such material from rinse water, a serious problem arises. The material that remains in the ion exchanger must be removed in order to regenerate the ion exchanger for further use. The regeneration of ion exchangers has traditionally been accomplished by employing a sodium hydroxide or sodium chloride (brine) aqueous backwash. This backwash liquor, after regeneration, contains the material that was removed from the rinse water. Thus, the problem remains of the disposing of the contaminated backwash liquor. This solution now contains a pollutant and must either be hauled away or the pollutant chemically precipitated. Such a system obviously is not practical and has not been generally employed in the etching industry. In addition, some commercial ion exchange substances for specialized applications are difficult to regenerate, and typically must be rinsed with hydrochloric acid solution and then neutralized with sodium hydroxide solution. This process generates large quantities of contaminated hydrochloric acid and sodium hydroxide solutions, and is obviously not acceptable.

SUMMARY OF THE INVENTION

1. Purposes of the Invention

It is an object of the present invention to provide an improvement in an etching process in which material is dissolved from a surface of a body in an etcher by contact with an aqueous etching solution and the resulting etched body is rinsed with an aqueous liquid to remove a residual film of etching solution.

Another object is to recover etched material from a rinse liquid in order to prevent water pollution by the liquid rinsing aqueous effluent from an etching process.

An additional object is to recover etched material from rinse water of an etching process in an improved manner.

A further object is to regenerate ion exchange means laden with etched material derived from an etching process in an improved manner.

Still another object is to utilize a component of an etching system to accomplish the regeneration of an ion exchanger laden with etched material derived from an etching process.

Still a further object is to regenerate an ion exchange substance laden with etched material derived from the rinse water of an etching process using a makeup aqueous etcher replenishing solution as the regenerating agent, and thereby to return the etched material to the etching system from whence it can be extracted from an aqueous etchant after the latter (aqueous etchant) is rich in such material and is withdrawn from the system.

These and other objects and advantages of the present invention will become evident from the description which follows.

2. Brief Description of the Invention

In the present invention, a method has been developed for effectively removing ions, e.g. metal cations, from an aqueous etching rinse liquid, in the process of etching material, e.g., metal, from the surface of a body in an etcher by contact with an aqueous etching solution. The method involves passing the rinse liquid, e.g., rinse water containing contaminant ions, e.g., metal cations, in dilute concentration through a conventional ion exchange substance, e.g., cationic. The rinse water leaving the ion exchange substance is essentially free of ions, e.g., metal, and can be reused as a rinse or sewered.

The ion exchange substance is typically a column filled with an ion exchange resin bed. The resins generally employed are strongly acidic cation exchange resins such a polystyrene matrix with a nuclear sulfonic acid active group, a sulfonated polystyrene cross-linked with divinyl benzene, or a phenolic matrix with a methylene sulfonic active group. Such resins are commercially available under such trade names as Dowex 50 and Dowex MSC-1 (Dow Chemical Co.); Duolite C-20 and Duolite C-3 (Diamond Shamrock Chemical Corp.); Ionac 240 or 249 (Ionac Chemical Corp.); and Amberlite DP-1 or XE-318 (Rohm & Haas).

Ion exchange columns are employed to treat rinse water from a diversity of etching systems. Probably the most important etching system of this nature is the spray etching of copper from a substrate in the manufacture of printed circuits and the like, in which a widely used etching solution in an aqueous solution of ammonium hydroxide and amonium chloride, containing complexed cupric ions as the active etchant which react with the metallic copper surface to yield cuprous chloride; the cuprous stage of valence being only transitory in nature since the air oxidation of cuprous to cupric in the complex takes place very rapidly. Typical ranges for the constituents of the solutions in ammoniacal alkaline spray etching of copper from a substrate are:

| Etching Solution | Moles/Liter |
|---|---|
| Copper ions (as metallic copper) | 1.0–2.8 |
| Ammonium chloride | 2.2–6.2 |
| Ammonium hydroxide to adjust to pH | 8.0–9.0 |
| Ammonium phosphate, monobasic, $NH_4H_2PO_4$ | 0.001–0.10 |
| Water q.s. to | 1 liter |
| Replenisher Solution | |
| Copper ions | 0 |
| Ammonium chloride | 2.2–5.2 |
| Ammonium hydroxide | 3.0–6.0 |
| Ammonium phosphate, monobasic, $NH_4H_2PO_4$ | 0.001–0.10 |
| Water q.s. to | 1 liter |
| pH | 9.0–10.0 |

Specific examples of well functioning starter and replenishing solutions are:

| Etching Solution | Moles/Liter |
|---|---|
| Copper ions (as metallic copper) | 2.00 |
| Ammonium chloride | 5.0 |
| Ammonium hydroxide | 6.0 |
| Ammonium phosphate | 0.01 |
| Water q.s. to | 1 liter |
| pH | 8.0–8.5 |
| Replenisher Solution | |
| Copper ions | 0 |
| Ammonium chloride | 4.5 |
| Ammonium hydroxide | 6.0 |
| Ammonium phosphate | 0.01 |
| Water q.s. to | 1 liter |
| pH | 9.5 |

Other suitable anions may additionally or alternatively be present in the etching solution in suitable instances. Thus, in general, typical anions such as sulfate, fluoride, acetate, etc., may be present instead of or in addition to the chloride and phosphate anions contemplated supra. Mixtures of these various anions may in fact be preferable in some instances, depending on various considerations such as the presence of additional chelating or buffering agents in the solution or other factors known to the art. In this regard, suitable additional chelating agents are triethylenetetraamine, diethylenetriamine, ethylenediamine tetraacetic acid and the like.

The invention is generally applicable to material etching procedures in which any of various materials is etched using any of various etchant solutions, being removed in ionic form, and in which a replenisher solution is provided. Another typical etching system to which the invention is applicable is as follows:

| CUPRIC CHLORIDE ETCHANTS (ACID) | |
|---|---|
| Typical Compositions | Grams/Liter |
| Cupric Chloride (Anhydrous) | 150 – 250 g. |
| Hydrochloric Acid (Concentrated) | 100 – 200 g. |
| Water to | 1 liter |

The above etchants are useful for etching copper.

In this exemplary system, a replenisher solution is provided which is generally amenable for utilization in accordance with the concept of the present invention.

In the typical instance of ammoniacal alkaline etching replenisher solution for copper spray etching using complexed cupric ions as the active etchant, the pollution problem described supra is eliminated by regenerating the copper-laden ion exchange substance with all or a portion of the replenisher solution stream prior to passing this stream to the sump of the spray etcher. The slight amount of copper added to the replenisher does not noticeably affect etching parameters. In an alternative mode, the stream after contacting the ion exchange substance and removing copper values as complexed cupric ions in solution may be recirculated to a replenisher recirculation module, from which overflow passes to the spray etcher sump. The replenisher solution contains ammonium chloride and ammonia, and thus will remove or exchange the copper ions in the ion exchanger with ammonium ions, thereby completing the regeneration cycle. The ammonia in the replenisher solution further enhances the process by complexing with the copper exchanged and preventing it from precipitating as a hydroxide and fouling the ion exchanger.

The resultant regenerant of low copper content, i.e., the replenisher solution, is sent directly into the etcher sump as a replenisher on a steady-state basis. The present invention thus eliminates the need for disposing of the conventional copper-containing sodium hydroxide or sodium chloride regerant solution.

The process in a preferred embodiment is provided with two ion exchange columns. One column is used to remove copper or other cations of the etched material from the rinse water, while the second is being regenerated by passing the replenisher solution through it during the course of passing the solution to replenish the etching solution in the etcher. Thus, the new system adds an ion exchanger between the replenisher pump and the etcher pump. When the first column is spent, i.e., its exchange capacity consumed, a plumbing circuit switches the replenisher regenerant to the first column and the copper-contaminated rinse water to the second column. This process can be repeated many times with a minimum cost and maintenance. This advantage is in addition to the basic advantages of elimination of a pollution problem since after regeneration the replenisher solution can be metered into the etcher as etchant replenisher. Thus, the present procedure eliminates the previous costly method with its inconvenient disposal problem.

The invention accordingly consists in the combination of elements, arrangement of parts and series of steps which will be exemplified in the method and sequence hereinafter described and of which the scope of application will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figure 1:
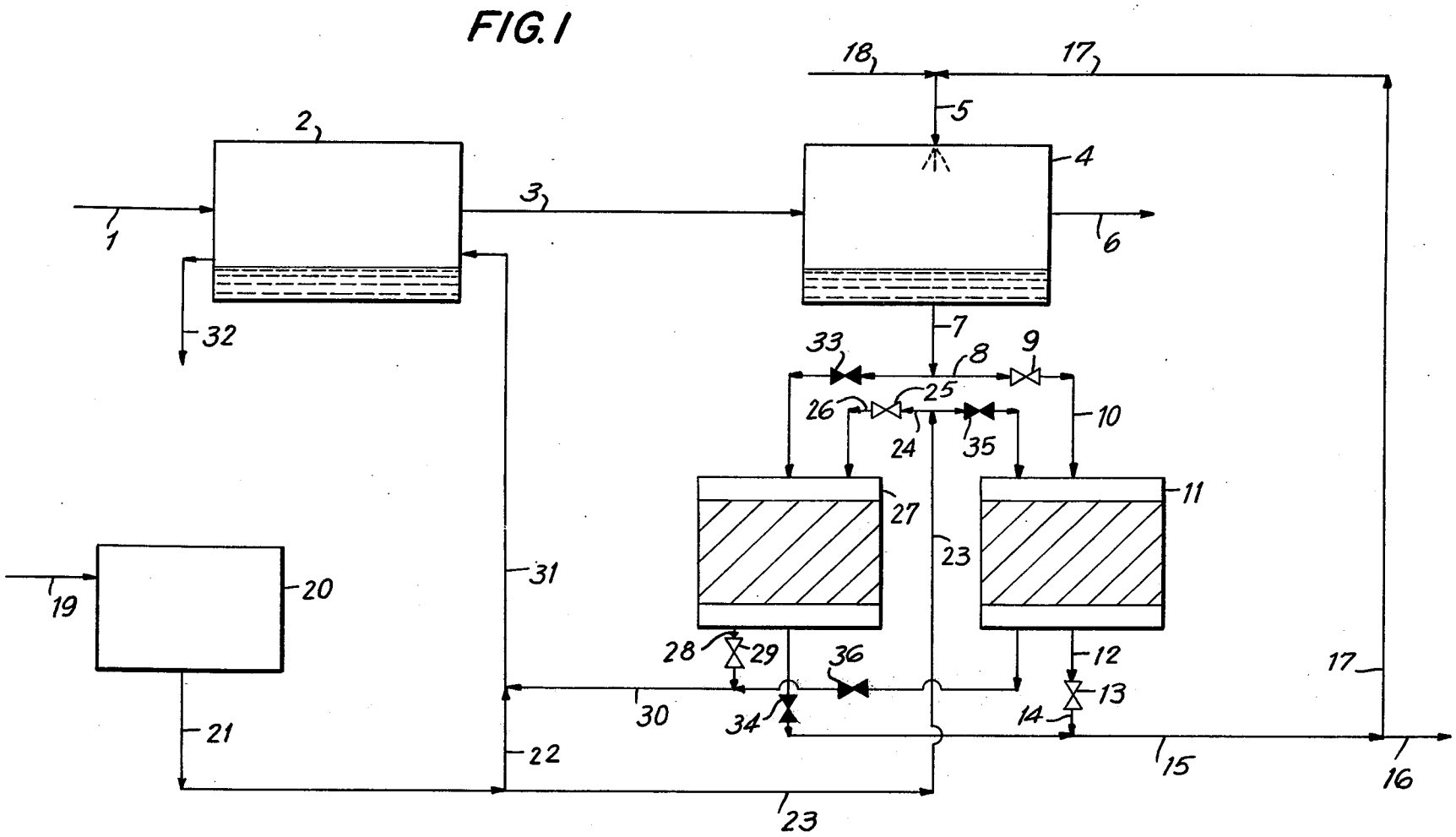
FIG. 1 is a flow diagram of a typical embodiment of the invention.

Referring now to FIG. 1, the solid to be etched and having a surface of etchable material, e.g., a metal, passes via stream 1 into etcher 2, which is typically a spray etcher or other type of etcher such as a splash etcher or the like. A typical spray etcher is shown and described in U.S. Pat. No. 3,348,657. Stream 1 is contacted with etching solution in unit 2 and metal is dissolved from the surface of the solid by etching solution containing an active etchant, such as those mentioned supra, and dissolved cations of the metal, generally in complexed form if the etchant is ammoniacal or of other type which includes a complexer for the metal. The etched solids are removed from the etcher 2 via stream 3 which passes into liquid rinse chamber 4 in which the solids are contacted with a spray or shower of rinse liquid stream 5, which is usually water or an aqueous solution, in order to wash off and remove entrained etchant solution which is initially present in stream 3 as coating films on the etched solids. The washed etched solids are removed from unit 4 via stream 6 and passed to further processing, not shown, or product utilization.

The spent rinse liquid in unit 4, now containing dissolved cations of the etched material in diluted amount derived from stream 3, collects in the lower portion or sump of unit 4 and passes via streams 7 and 8 through open valve 9. In the description infra, open valves such as valve 9 are shown in open outline while closed valves are shown in solid black. The valves are periodically switched from open to closed position to reverse the ion exchange and regeneration cycles, as will appear infra. The spent rinse liquid proceeds from valve 9 via stream 10 into ion exchange means 11 which is exemplicatively a cation exchange resin bed of the types mentioned supra, and in which the metal cations are selectively retained on the ion exchange substance which releases cations previously derived from replenisher solution, so that the ion exchange means 11 steadily becomes more laden with metal cations. The resulting rinse liquid stream 12 discharged from unit 11 is now depleted of metal cations and in most instances will be substantially devoid of metal cations. Stream 12 now typically passes via valve 13 and streams 14 and 15 to stream 16, which may be safely discharged to a sewer or a body of water such as a stream or lake without causing water pollution. In some instances, it will be feasible to recycle all or a portion of stream 15 via streams 17 and 5 for further rinsing in unit 4. Makeup rinse liquid may be added to the system via stream 18.

When the etching solution in etcher 2 becomes laden with dissolved etched material cations to a concentration at or above an optimum level, due to the dissolving of material from stream 1, a portion of the etching solution is removed from etcher 2 and replaced by replenishing solution containing chemicals to replace those removed with the portion of the etching solution except for the presence of a lesser concentration of etched material cations. In many instances, the replenisher solution per se as supplied to the facility is essentially devoid of etched material cations. Thus, replenisher solution stream 19 is supplied from an outside source and in typical instance of etching of copper using an ammoniacal cupric complex as the active etchant, stream 19 will contain ammonium hydroxide in aqueous solution together with an ammonium compound having an anion such as chloride, nitrate, acetate, trichloroacetate, sulfate, fluoride, and/or bicarbonate or the like. Stream 19 is usually shipped to the etching facility in bulk, or formulated at the facility in batch amounts, and stream 19 is thus supplied to bulk storage tank 20 from which stream 21 is periodically or contnuously withdrawn to flow eventually into etcher 2. Stream 21 in this embodiment of the invention is divided into streams 22 and 23. The latter stream 23 is utilized in accordance with the present invention, and is passed via stream 24, valve 25 and stream 26 into etched material cation-laden ion exchange means 27 in order to regenerate the resin or the like in unit 27 by selective displacement of etched material cations from the resin. As mentioned supra, when the etchant solution is an ammonium-based solution, the etched material cation such as copper will be removed from the resin bed in unit 27 as a dissolved cupric-ammonium complex. The resulting replenishing solution now contained a small added proportion of etched material cations is removed from unit 27 via stream 28, which passes via valve 29 and stream 30 for addition to stream 22 to form combined stream 31 which now passes into etcher 2. Spent etching solution containing a high proportion of dissolved etched material cations is periodically or continuously withdrawn from unit 2 via stream 32 and passed to waste disposal or other utilization such as the recovery of metal values.

The stream flows described supra continue generally until unit 11 becomes laden with etched material cations to the point where an undesirable concentration of such cations begins to appear in stream 12. This time period may be established empirically for a particular system of etchant, metal, resin, relative proportions of flow rate and metal concentration of stream 10, size of resin bed in unit 11, etc., or by a sensor. In any event a point is reached where it becomes desirable to switch unit 11 to the regeneration period of the cycle and to switch unit 27 to the etched material cation absorption by ion exchange portion of the cycle. At this point, valves 9, 13, 25 and 29 are closed and valves 33, 34, 35 and 36 are concomitantly opened so that the respective roles of units 11 and 27 are reversed. The subsequent resultant stream flows are evident from FIG. 1, thus stream 7 will then flow through unit 27 via valves 33 and 34, and stream 23 will then flow through unit 11 via valves 35 and 36. Pumps (not shown) are provided to provide the various directions of flow described above.

Figure 2:
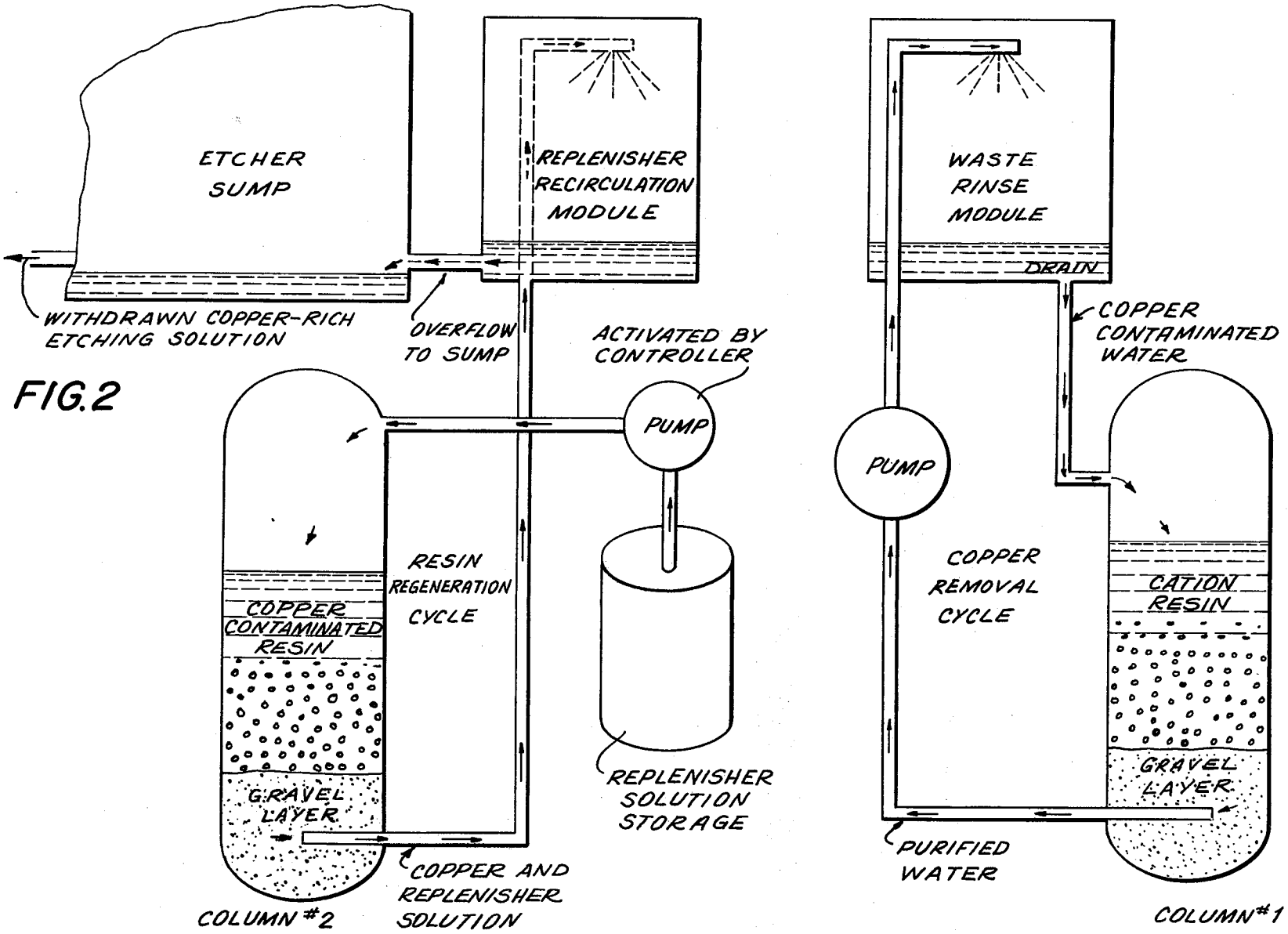
FIG. 2 is a schematic outline of a portion of the system of FIG. 1, as applied to the etching of copper from a substrate.

Referring now to FIG. 2, there is shown a specific embodiment of the invention, in which all of the replenisher solution flows first through a resin bed of column No. 2 for regeneration of the resin and then to the etcher, this embodiment is shown for a typical system in which the material being etched from a substrate is copper and the rinse liquid is water.

An example of experimental and test work done to prove the practical value of the present invention will now be described.

EXAMPLE

The present procedure was run with a cation exchange resin using a replenisher solution containing ammonium chloride and ammonium hydroxide. Excellent results were achieved. Several other ammonium salts were successfully tested, namely ammonium nitrate, ammonium trichloroacetate, ammonium sulfate and ammonium bicarbonate. Several acids were also tested and found to work quite well. Sulfuric, hydrochloric and nitric acids can be used to regenerate the resin. Caution must be used when regenerating with these acids. Heat buildup and evolution of gases were observed.

EVALUATION TECHNIQUE

To determine the effectiveness of various regeneration solutions, an ion exchange column of Ionac C-249 was used. A 3.1 cm (I.D.) column with a bed height of 19 cm. gave a 150 ml. volume.

FACTORS DETERMINING EFFICIENCY OF RESIN

Flow Rate

A proper flow rate is needed to achieve the maximum efficiency. A flow rate of 75 ml. per minute worked well and was the flow rate used for the runs. This flow rate often dropped off as the resin packed towards the end of a test. Faster flow rates can be used, but it is necessary to recirculate the solution. If the flow rate is raised to 150 ml. per minute it is necessary to pass the liquid through the resin twice to achieve the same results.

Concentration

The concentration of the copper containing solution used was 16.7 g/l[Cu°]. This resin could not handle concentrations above this without reducing the flow rate. It is difficult to determine what concentration can be handled at a specific flow rate because the flow rate is constantly changing because of resin packing.

Regeneration

A 1 molar concentration was used with all regenerating solutions. The quantity of solution used varied with the flow rate. As the resin packed and the flow rate was reduced the quantity of solution needed was correspondingly reduced. Maintaining a constant flow rate was nearly impossible and it was therefore difficult to calculate exactly what volume of 1 molar salt solution would completely regenerate the 150 ml. volume of resin. It was however observed that 3–5 liters of 1 molar salt solution would generally be a sufficient quantity to regenerate the resin bed.

Effect of $NH_4OH$

Regeneration with NaCl was not complete due to a buildup of cupric hydrate. This was true with all of the salts tested. An addition of 10% 26° $NH_4OH$ dissolved this precipitate.

COPPER CAPACITY TABULATION

| Chemical Regeneration Regeneration Solution | COPPER CAPACITY Grams per Liter of Resin: Virgin Resin | Regenerated Resin |
|---|---|---|
| | g/l | g/l |
| Sodium Chloride | 50 | 45 |
| Ammonium Chloride $+NH_4OH$ | 50 | 50 |
| Sodium Chloride $+NH_4OH$ | 50 | 50 |
| Ammonium Bicarbonate $+NH_4OH$ | 50 | 50 |
| Ammonium Nitrate $+NH_4OH$ | 50 | 50 |
| Ammonium Acetate $+NH_4OH$ | 50 | 50 |
| Ammonium Trichloracetate $+NH_4OH$ | 50 | 50 |
| Ammonium Sulfate $+NH_4OH$ | 50 | 50 |
| Acid Regeneration | | |
| Sulfuric Acid (10% vol.) | 50 | 50 |
| Hydrochloric Acid (10% vol.) | 50 | 50 |
| Nitric Acid (10% vol.) | 50 | 50 |

It thus will be seen that there is provided a method and apparatus which achieve the various objects of the invention and which are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention, there is claimed as new and desired to be secured by Letters Patent:

1. In an etching process in which
   - A. a material is dissolved as cations from a surface of a body in an etcher by contact with an etching solution, said etching solution containing
     - I. an active etchant and
     - II. dissolved cations of such material,
   - B. a stream of aqueous replenishing solution containing a lesser concentration of such cation than said etching solution is passed into said etcher, and some etching solution is removed,
   - C. said body is
     - I. withdrawn from said etcher and
     - II. rinsed with a liquid,
   - D. whereby residual etching solution containing cations of said material is washed from said body and diluted by said liquid,
   - E. the resulting diluted liquid containing dissolved cations of said material is passed in contact through cation exchange means which selectively retains cations of said material whereby said cation exchange means becomes laden with cations of said material,
   - F. said cation exchange means is regenerated by
     - I. terminating the flow of said resulting liquid and
     - II. then passing a regenerating solution stream through said cation exchange means to remove cations of said material from said cation exchange means, the improvement of:
   - G. regenerating said cation exchange means by
     - I. passing at least a portion of said replenishing solution stream through said cation exchange means
     - II. before passing said replenishing solution portion into said etcher,
     - III. whereby cations of said material are removed from said cation exchange means and introduced into said replenishing solution stream portion.

2. The method of claim 1, in which said material is copper.

3. The method of claim 1, in which all of said aqueous replenishing solution stream is passed through said cation exchange means.

4. The method of claim 1, in which the liquid is water.

5. The method of claim 1, in which the cation exchange means contains a cation exchange resin.

6. The method of claim 6, in which the cation exchange resin is a strongly acidic cation exchange resin selected from the group consisting of a polystyrene matrix with a nuclear sulfonic acid active group, a sulfonated polystyrene cross-linked with divinyl benzene, and a phenolic matrix with a methylene sulfonic active group.

7. In an ammoniacal alkaline copper etching process in which
   - A. copper metal is dissolved from a surface of a body in an etcher by contact with an aqueous etching solution containing
     - I. ammonium and
     - II. complexed cupric cations,
   - B. a portion of the etching solution laden with complexed cupric ions is withdrawn and replaced with a stream of aqueous replenishing solution containing ammonium ions,
   - C. said body is withdrawn from said etcher and rinsed with an aqueous solution,
   - D. whereby residual etching solution containing complexed copper ions is washed from said body and diluted by said aqueous solution,
   - E. the resulting aqueous solution is passed through cation exchange means whereby cupric ions are selectively retained in said cation exchange means and said cation exchange means becomes laden with cupric ions,
   - F. said cation exchange means is regenerated by
     - I. terminating the flow of said resulting aqueous solution and
     - II. then passing a regenerating solution through said cation exchange means to remove cupric ions from said cation exchange means, the improvement of:
   - G. regenerating said cation exchange means by
     - I. passing at least a portion of said aqueous replenishing solution stream through said cation exchange means,
     - II. before passing said replenishing solution stream portion into said etcher,
     - III. whereby cupric ions are removed from said cation exchange means and introduced into said aqueous replenishing solution stream in the form of a cupric ammonium complex.

8. The method of claim 7, in which all of the aqueous replenishing solution stream is passed through said cation exchange means.

9. The method of claim 7, in which the resulting aqueous replenishing solution stream containing complexed cupric ions is passed into the etcher.

10. The method of claim 7, in which the aqueous replenishing solution stream contains a dissolved ammonium compound having an anion selected from the group consisting of chloride, nitrate, acetate, trichloracetate, sulfate, fluoride and bicarbonate, and mixtures thereof.

11. The method of claim 7, in which the aqueous solution is water.

12. The method of claim 7, in which the cation exchange means contains a cation exchange resin.

13. The method of claim 12, in which the cation exchange resin is a strongly acidic cation exchange resin selected from the group consisting of a polystyrene matrix with a nuclear sulfonic acid active group, a sulfonated polystyrene cross-linked with divinyl benzene, and a phenolic matrix with a methylene sulfonic active group.

14. The method of claim 7, in which the aqueous etching and replenishing solutions contain a chelating agent selected from the group consisting of triethylenetetraamine, diethylenetriamine, and ethylenediamine tetraacetic acid.

* * * * *